US009707440B2

(12) United States Patent
Zeng

(10) Patent No.: US 9,707,440 B2
(45) Date of Patent: Jul. 18, 2017

(54) UPRIGHT BIKE WITH PULL TRAINING FUNCTION

(71) Applicant: Cian-Chang Zeng, Caotun Town, Nantou County (TW)

(72) Inventor: Cian-Chang Zeng, Caotun Town, Nantou County (TW)

( * ) Notice: Subject to any disclaimer, the term of this patent is extended or adjusted under 35 U.S.C. 154(b) by 24 days.

(21) Appl. No.: 14/974,942

(22) Filed: Dec. 18, 2015

(65) Prior Publication Data

US 2017/0043207 A1 Feb. 16, 2017

(30) Foreign Application Priority Data

Aug. 11, 2015 (TW) ..... 104212922 U

(51) Int. Cl.

| | |
|---|---|
| ***A63B 22/00*** | (2006.01) |
| ***A63B 21/00*** | (2006.01) |
| ***A63B 21/02*** | (2006.01) |
| ***A63B 22/06*** | (2006.01) |
| ***A63B 23/035*** | (2006.01) |

(52) U.S. Cl.

CPC ..... *A63B 22/0012* (2013.01); *A63B 21/0004* (2013.01); *A63B 21/02* (2013.01); *A63B 21/4034* (2015.10); *A63B 21/4035* (2015.10); *A63B 22/0015* (2013.01); *A63B 22/0605* (2013.01); *A63B 23/03575* (2013.01); *A63B 2022/0611* (2013.01)

(58) Field of Classification Search

CPC . A63B 21/225; A63B 22/0605; A63B 22/001; A63B 22/0664; A63B 2225/09; A63B 22/0056; A63B 22/0023; A63B 21/015

USPC ..... 482/51–62

See application file for complete search history.

(56) References Cited

U.S. PATENT DOCUMENTS

| | | | | |
|---|---|---|---|---|
| 5,211,613 | A * | 5/1993 | Friesl | A63B 21/0088 416/197 R |
| 7,097,598 | B2 * | 8/2006 | Lee | A63B 22/0012 482/57 |
| 7,422,548 | B1 * | 9/2008 | Teng | A63B 21/0051 482/51 |
| 7,481,746 | B2 * | 1/2009 | Ibarguren | A63B 22/0605 482/57 |
| 8,876,669 | B2 * | 11/2014 | Vujicic | A63B 21/225 482/57 |
| 2002/0004439 | A1 * | 1/2002 | Galbraith | A63B 22/0605 482/57 |

(Continued)

*Primary Examiner* — Andrew S Lo

(74) *Attorney, Agent, or Firm* — Egbert Law Offices, PLLC

(57) ABSTRACT

An upright bike includes a main frame including a front portion and a rear portion. A rail structure is connected to the rear portion of the main frame. An X-shaped frame is slidably mounted to the rail structure and pivotally connected to the front portion of the main frame. A slide end is formed on the X-shaped frame and slidably mounted onto the rail structure. A stepping structure is mounted on a lower section of the first trestle of the X-shaped frame. A seat is secured on a top of the first trestle of the X-shaped frame. A handlebar is transversally secured on the X-shaped frame. A restitute element has two opposite ends respectively secured on the first trestle and the second trestle of the X-shaped frame for providing restitution force to the X-shaped frame when the handlebar is upwardly pulled.

5 Claims, 7 Drawing Sheets

(56) References Cited

U.S. PATENT DOCUMENTS

| | | | | |
|---|---|---|---|---|
| 2004/0214693 | A1* | 10/2004 | Piaget | A63B 22/0056 482/52 |
| 2012/0322625 | A1* | 12/2012 | Park | A63B 22/0012 482/62 |
| 2015/0011361 | A1* | 1/2015 | Boyette | A63B 24/0087 482/8 |
| 2015/0335936 | A1* | 11/2015 | Shakespeare | A63B 21/0084 482/58 |

* cited by examiner

UPRIGHT BIKE WITH PULL TRAINING FUNCTION

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to an upright bike, and more particularly to an upright bike with a pull training function.

2. Description of Related Art Including Information Disclosed Under 37 CFR 1.97 and 37 CFR 1.98.

A conventional upright bike in accordance with the prior art is a widely used indoor exercise device for simulating the motions of riding a bicycle and providing exercise effect. The upright bike is a very historic exercise device. Consequently, all the manufacturers rack their brains for providing additional functions to the conventional upright bikes for promoting entertainment, exercise effect or reducing manufacturing cost.

It is a serious problem of the conventional upright bike is only to provide exercise effect to the user's feet. However, the conventional upright bike manufacturers are anxious to provide an altered upright bike has a structure that is too complicated and expensive.

The present invention has arisen to mitigate and/or obviate the disadvantages of the conventional upright bike.

BRIEF SUMMARY OF THE INVENTION

The main objective of the present invention is to provide an improved upright bike that has a pull training function.

To achieve the objective, the upright bike in accordance with the present invention comprises a main frame including a front portion and a rear portion. A rail structure is connected to the rear portion of the main frame. An X-shaped frame is slidably mounted to the rail structure and pivotally connected to the front portion of the main frame. The X-shaped frame includes a first trestle and a second trestle each having a middle portion laterally pivotally connected to each other by a pivot axle that extends through the first trestle and the second trestle. A hinge end is formed on a lower portion of the first trestle and pivotally connected to the front portion of the main frame. A slide end is formed on a rear end of the second trestle and slidably mounted onto the rail structure. A stepping structure is mounted on a lower section of the first trestle of the X-shaped frame. The stepping structure includes a crank rotatably extending through the first trestle of the X-shaped frame. Two pedals are respectively pivotally mounted on two opposite ends of the crank. A damping device is rotatably mounted to the first trestle of the X-shaped frame and rotated with the crank for promoting the exercise effect of the upright bike in accordance with the present invention. A seat is secured on a top of the first trestle of the X-shaped frame. A handlebar is transversally secured on a top of the second trestle of the X-shaped frame. The slide end of the second trestle is moved along the rail structure and the seat secured on the top of the first trestle is lifted when the handlebar is upwardly pulled. A restitute element has two opposite ends respectively secured on the first trestle and the second trestle of the X-shaped frame for providing restitution force to the X-shaped frame when the handlebar is upwardly pulled.

Further benefits and advantages of the present invention will become apparent after a careful reading of the detailed description with appropriate reference to the accompanying drawings.

DETAILED DESCRIPTION OF THE INVENTION

Figure 1:
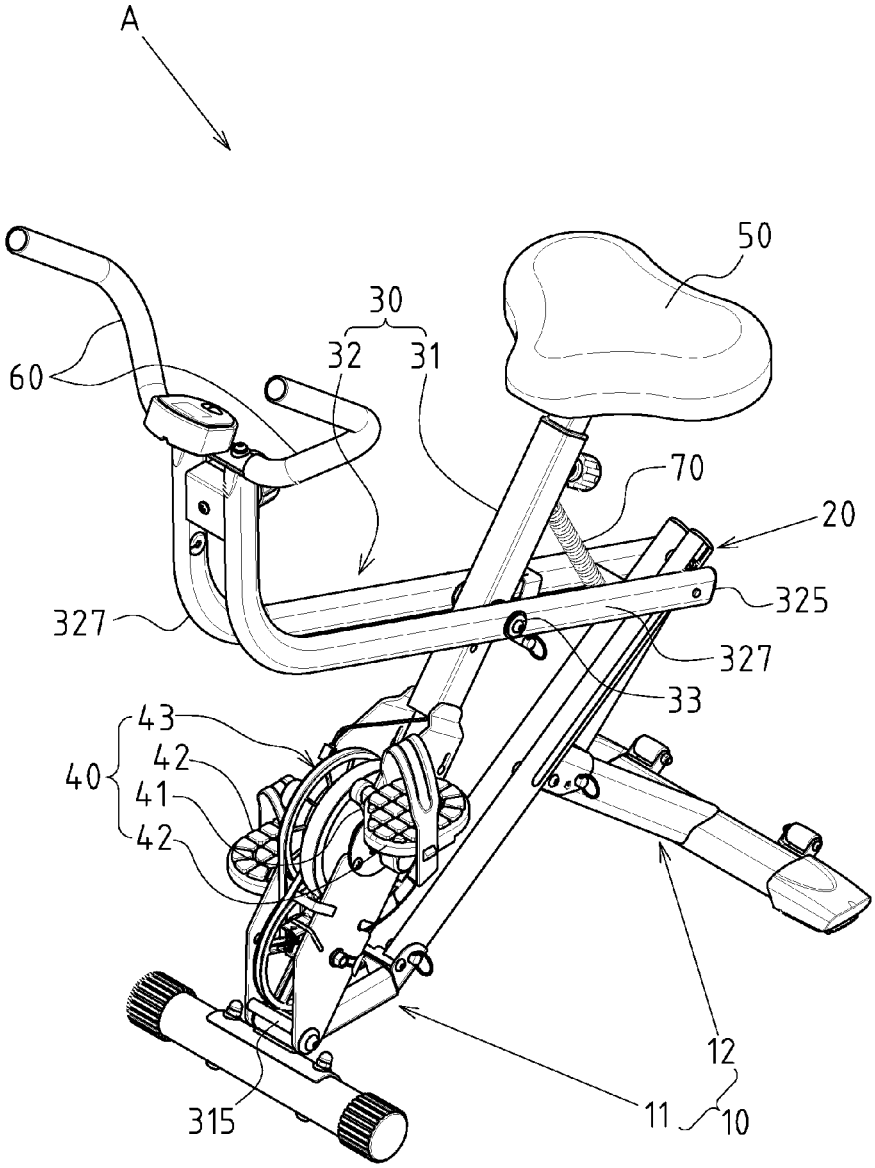
FIG. 1 is a perspective view of an upright bike with a pull training function in accordance with the present invention.
Figure 2:
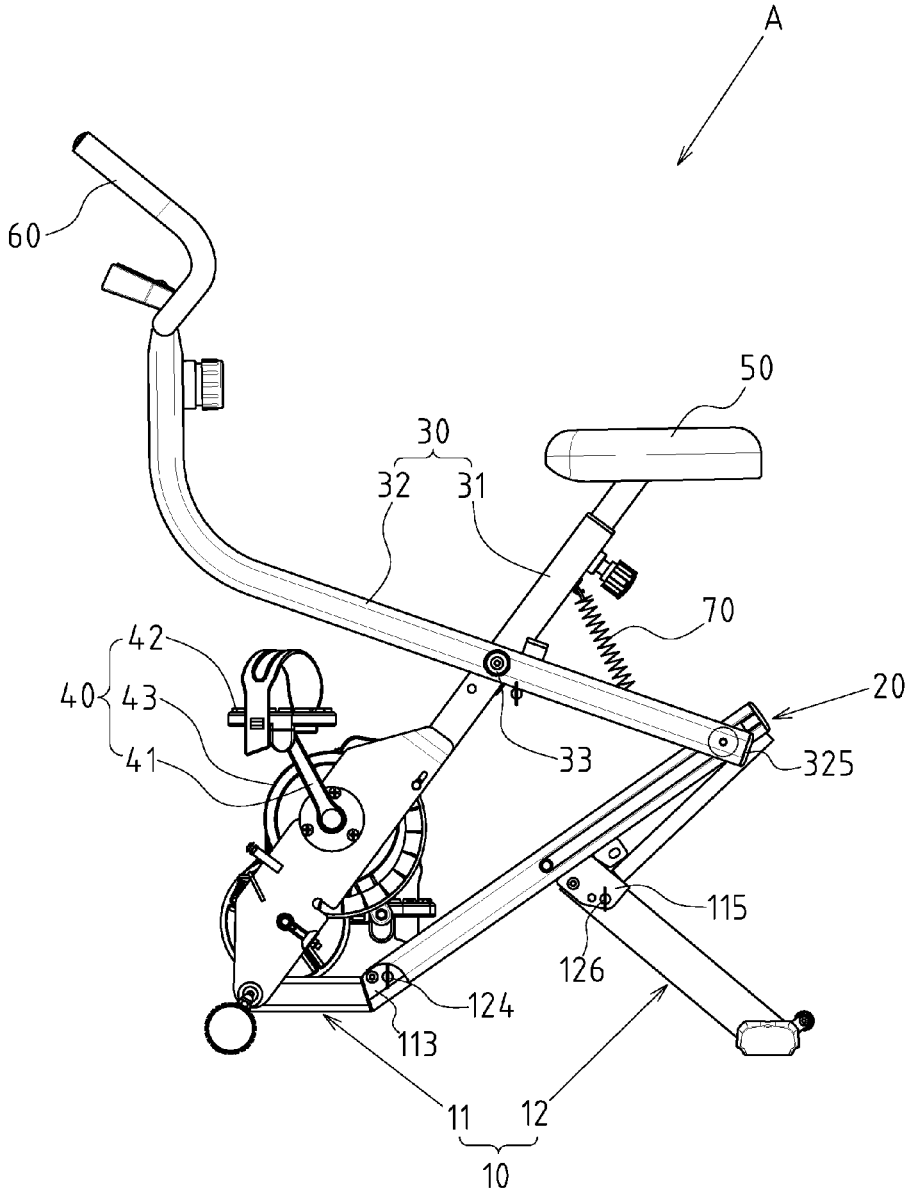
FIG. 2 is a side plan view of the upright bike in FIG. 1.

Referring to the drawings and initially to FIGS. 1-4, an upright bike A with pull training function in accordance with the present invention comprises a main frame 10 including a front portion 11 and a rear portion 12. A rail structure 20 is connected to the rear portion 12 of the main frame 10, and backward and upwardly extends. An X-shaped frame 30 is slidably mounted to the rail structure 20 and pivotally connected to the front portion 11 of the main frame 10. The X-shaped frame 30 includes a first trestle 31 and a second trestle 32 each having a middle portion laterally pivotally connected to each other by a pivot axle 33 that extends through the first trestle 31 and the second trestle 32. A hinge end 315 is formed on a lower portion of the first trestle 31 and pivotally connected to the front portion 11 of the main frame 10. A slide end 325 is formed on a rear end of the second trestle 32 and slidably mounted onto the rail structure 20. A stepping structure 40 is mounted on a lower section of the first trestle 31 of the X-shaped frame 30. The stepping structure 40 includes a crank 41 rotatably extending through the first trestle 31 of the X-shaped frame 30. Two pedals 42 are respectively pivotally mounted on two opposite ends of the crank 41. A damping device 43 is rotatably mounted to the first trestle 31 of the X-shaped frame 30 and rotated with the crank 41 for promoting the exercise effect of the upright bike A in accordance with the present invention. A seat 50 is secured on a top of the first trestle 31 of the X-shaped frame 30. A handlebar 60 is transversally secured on a top of the second trestle 32 of the X-shaped frame 30. The slide end 325 of the second trestle 32 is moved along the rail structure 20 and the seat 50 secured on the top of the first trestle 31 is lifted when the handlebar 60 is upwardly pulled. A restitute element 70 has two opposite ends respectively secured on the first trestle 31 and the second trestle 32 of the X-shaped frame 30 for providing restitution force to the X-shaped frame 30 when the handlebar 60 is upwardly pulled.

Figure 3:
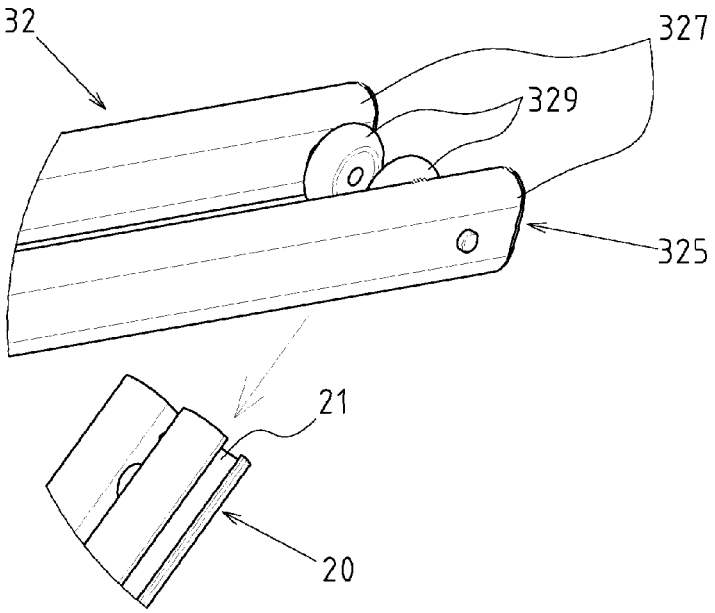
FIG. 3 is a partially exploded perspective view of the upright bike in FIG. 1.
Figure 4:
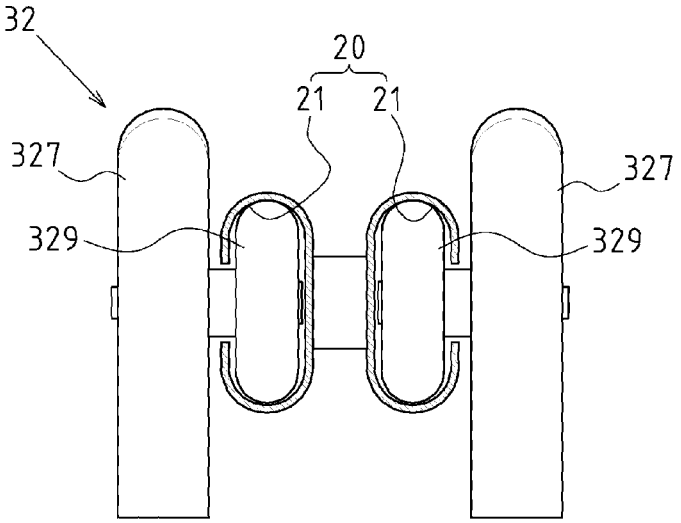
FIG. 4 is a partially cross-sectional view of the upright bike in FIG. 1.

With reference to FIGS. 3 and 4, the rail structure 20 has two T-shaped grooves 21 respectively defied in two opposite sides of the rail structure 20. The slide end 325 is formed with two stems 327 each having a roller 329 laterally mounted thereon, wherein each roller 329 is moved in a corresponding one of the two T-shaped grooves 21.

The restitute element 70 is at least one spring or at least one resilient rope. In the preferred embodiment of the present invention, the two opposite ends of the restitute element 70 are respectively secured on rear sections of the first trestle 31 and the second trestle 32 of the X-shaped frame 30. Consequently, an angle formed between the first trestle 31 and the second trestle 32 is enlarged and the restitute element 70 is expanded when the handlebar 60 is upwardly pulled, as shown in FIG. 6.

Figure 5:
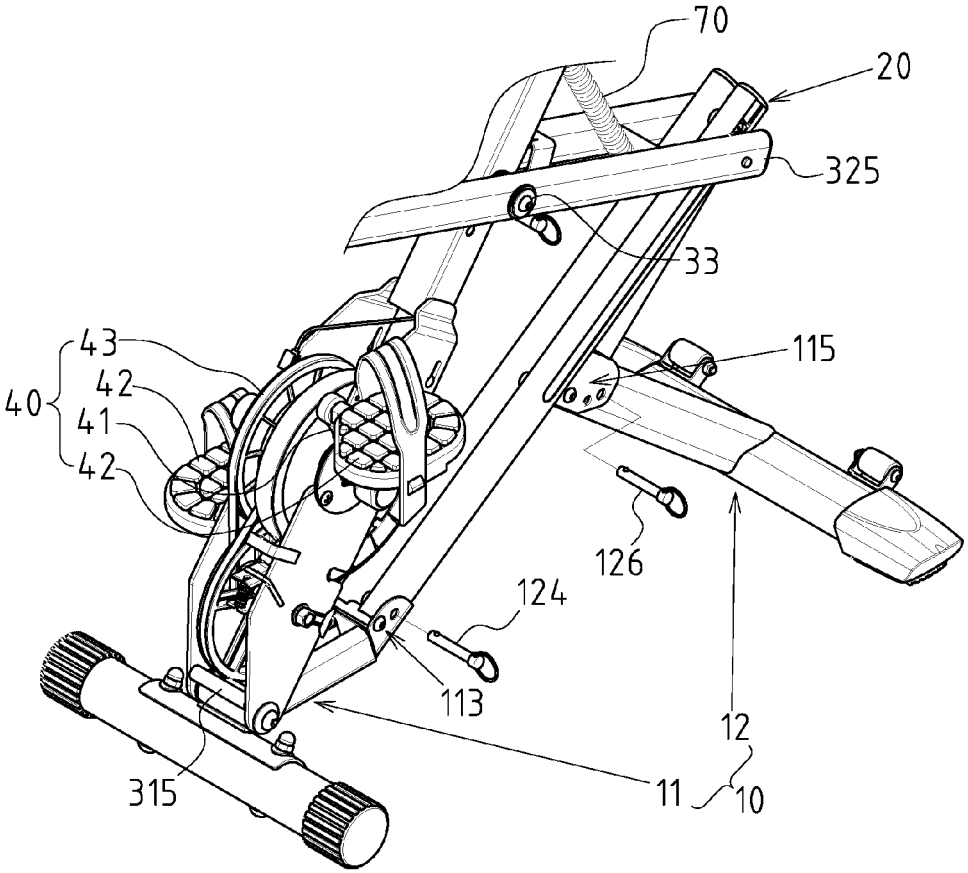
FIG. 5 is another partially exploded perspective view of the upright bike in FIG. 1.
Figure 9:
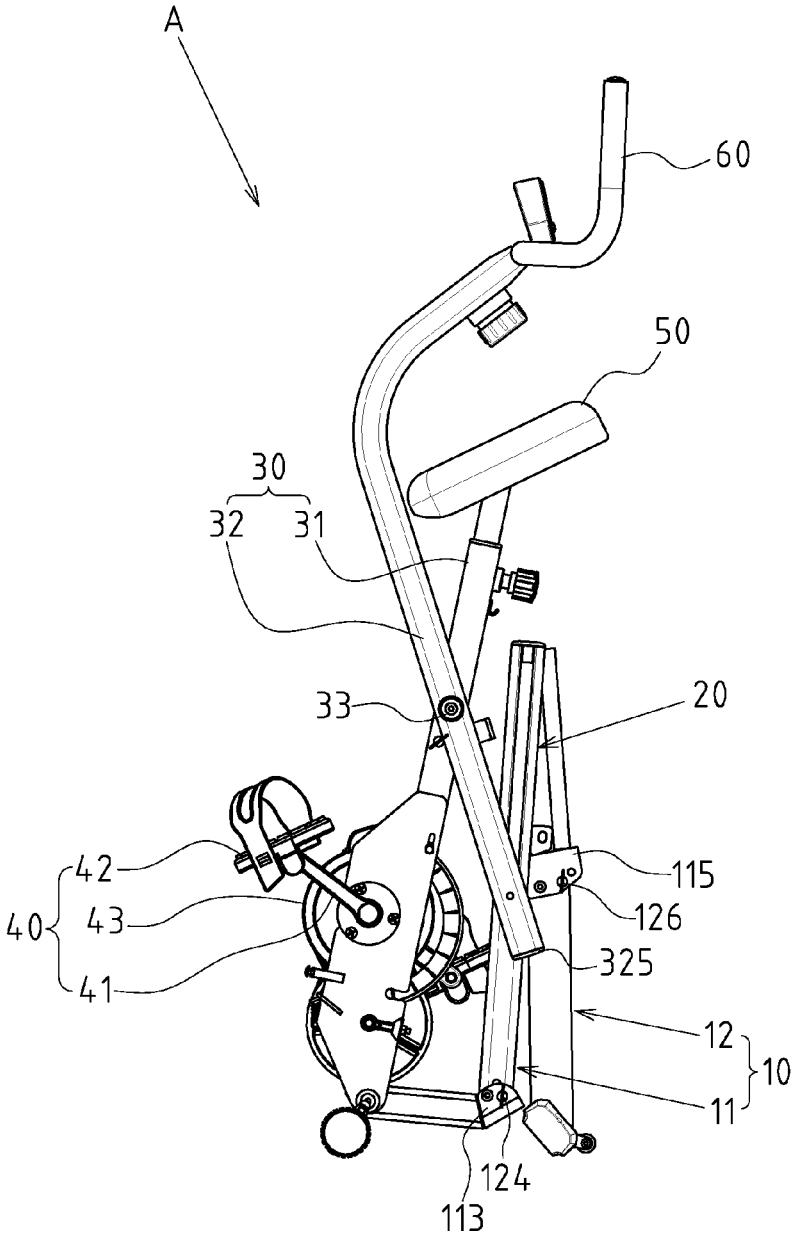
FIG. 9 is a side plan view of the upright bike when being folded.

With reference to FIG. 5, the front portion 11 and the rear portion 12 of the main frame 10 respectively have a first joint 113 and a second joint 115 secured thereon, wherein a first locking pin 124 and a second locking pin 126 selectively and respectively extend through the first joint 113 and the second joint 115 for providing a folding function to the main frame 10 of the upright bike A in accordance with the present invention, as shown in FIG. 9.

Figure 6:
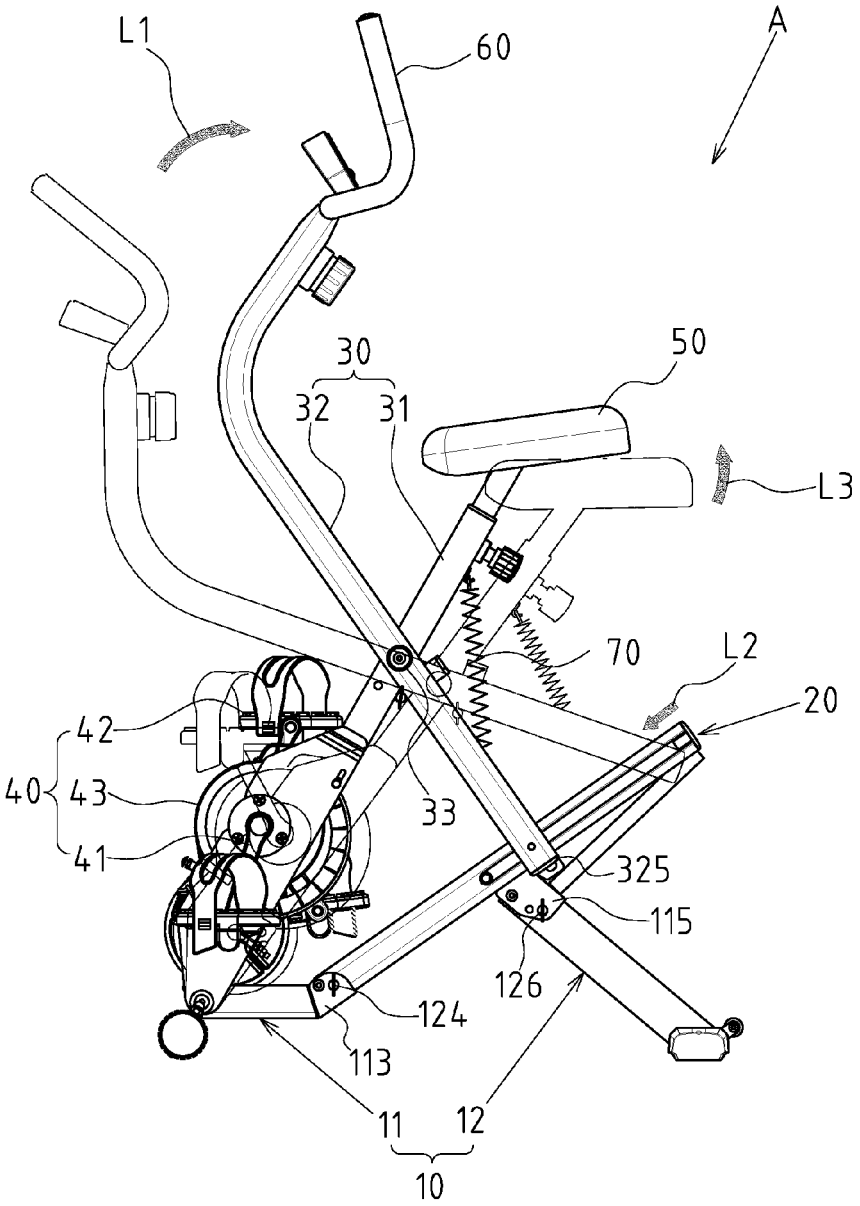
FIG. 6 is a schematic view of the upright bike in FIG. 1.
Figure 8:
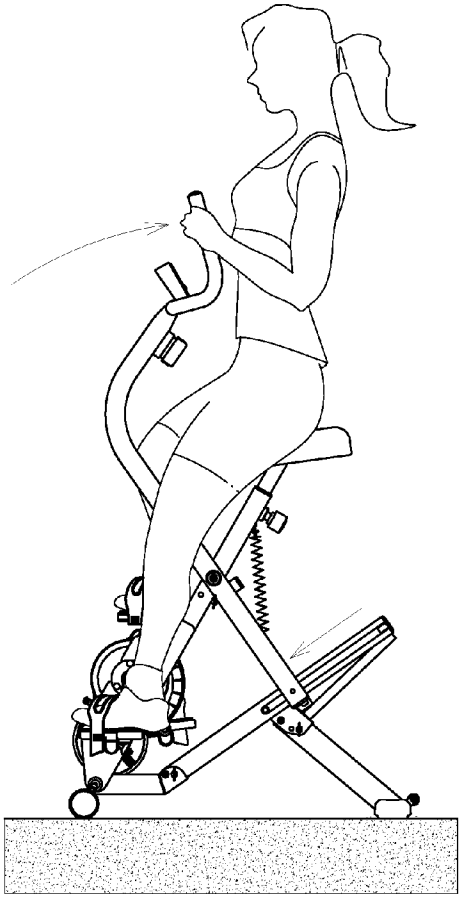
FIG. 8 is a second operational view of the upright bike in accordance with the present invention.
Figure 7:
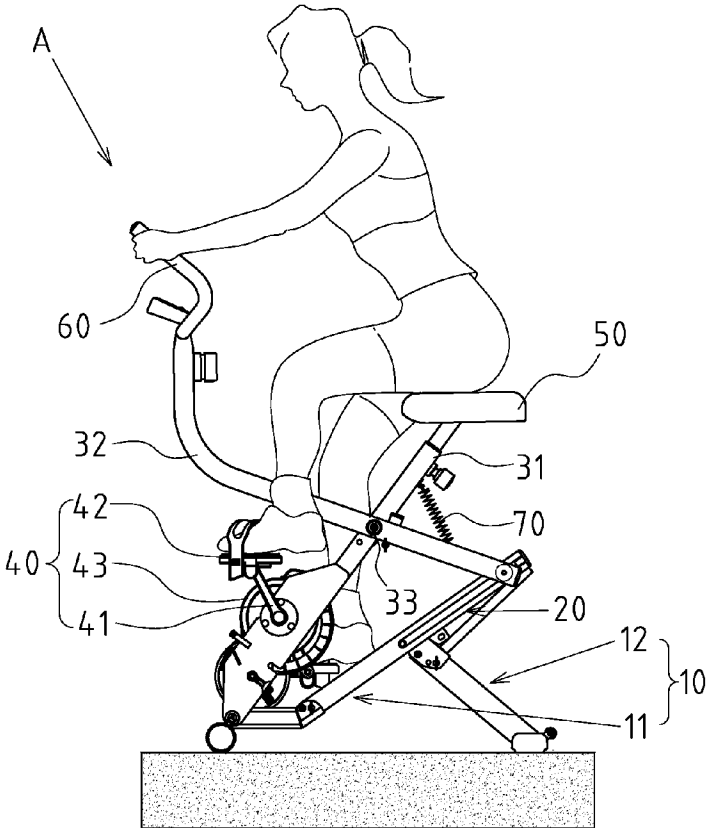
FIG. 7 is a first operational view of the upright bike in accordance with the present invention.

In the structures of the upright bike A in accordance with the present invention, with reference to FIG. 6, the first trestle 31 and the second trestle 32 is pivoted to each other by the pivot axle 33. The first trestle 31 formed with a hinge end 315 pivotally connected to the front portion 11 of the main frame 10 and the second trestle 32 formed with a slide end 325 moved along the rail structure 20. Consequently, the slide end 325 of the second trestle 32 is moved along the rail structure 20, along the arrow L2, and the seat 50 secured on the top of the first trestle 31 is lifted, along the arrow L3, when the handlebar 60 is upwardly pulled, along the arrow L1. By the structure of the upright bike A in accordance with the present invention, in the first operational mode, as shown in FIG. 7, the user sits on the seat 50, holds the two opposite ends of the handlebar 60 and steps on the two pedals 42 of the stepping structure 40. In this mode, the upright bike A in accordance with the present invention is operated as an ordinary upright bike. In the first operational mode, as shown in FIG. 8, during the user upwardly pulling the handlebar 60, the slide end 325 of the second trestle 32 is downward moved along the rail structure 20 and the seat 50 on the top of the first trestle 31 is lifted. In the meanwhile, the user changes his/her posture from sitting posture to stance and the angle of his/her elbow is changed. Consequently, the upright bike A in accordance with the present invention not only trains user's feet, but also trains user's hands, arms, waist and back, especially user's arm due to the action of upwardly pulling the handlebar 60. As a result, the upright bike A in accordance with the present invention has advantageously altered the conventional upright bike that has only one function of train user's feet.

In addition, the upright bike A in accordance with the present invention achieves the above function by providing the X-shaped frame 30 to the conventional upright bike. Consequently, the upright bike A in accordance with the present invention is easily manufactured and assembled, and has a low cost for mass-produced.

Although the invention has been explained in relation to its preferred embodiment, it is to be understood that many other possible modifications and variations can be made without departing from the spirit and scope of the invention as hereinafter claimed.

I claim:

1. An upright bike apparatus with a pull training function, the upright bike apparatus comprising:

a main frame having a front portion and a rear portion;

a rail structure connected to said rear portion of said main frame;

an X-shaped frame slidably mounted to said rail structure and pivotally connected to said front portion of said main frame, said X-shaped frame having a first trestle and a second trestle each having a middle portion laterally pivotally connected to each other by a pivot axle that extends through said first trestle and said second trestle, wherein a hinge end is formed on a lower portion of said first trestle and is pivotally connected to said front portion of said main frame, wherein a slide end is formed on a rear end of said second trestle and is slidably mounted onto said rail structure, wherein said rail structure has two T-shaped grooves respectively defined in two opposite sides thereof, said slide end being formed with two stems each having a roller laterally mounted thereon, wherein each of the rollers is movable in a corresponding one of the two T-shaped grooves;

a stepping structure mounted on a lower section of said first trestle of said X-shaped frame, said stepping structure having a crank rotatably extending through said first trestle of said X-shaped frame, wherein two pedals are respectively pivotally mounted on two opposite ends of said crank, and wherein a damping device is rotatably mounted to said first trestle of said X-shaped frame and rotatable with said crank;

a seat secured on a top of said first trestle of said X-shaped frame;

a handlebar transversely secured on a top of said second trestle of said X-shaped frame, said slide end of said second trestle being movable along said rail structure, said seat being lifted when said handlebar is upwardly pulled; and a restitute element having two opposite ends respectively secured on said first trestle and said second trestle of said X-shaped frame so as to provide a restitution force to said X-shaped frame when said handlebar is upwardly pulled.

2. The upright bike apparatus of claim 1, wherein said restitute element has at least one spring.

3. The upright bike apparatus of claim 1, wherein said restitute element has at least one resilient rope.

4. The upright bike apparatus of claim 2, wherein said front portion and said rear portion of said main frame respectively have a first joint and a second joint secured thereon, wherein a first locking pin and a second locking pin selectively and respectively extend through said first joint and said second joint so as to provide a folding function to said main frame.

5. The upright bike apparatus of claim 3, wherein said front portion and said rear portion of said main frame respectively have a first joint and a second joint secured thereon, wherein a first locking pin and a second locking pin selectively and respectively extend through said first joint and said second joint so as to provide a folding function to said main frame.

* * * * *